US005080192A

United States Patent [19]

Kerr

[11] Patent Number: 5,080,192

[45] Date of Patent: Jan. 14, 1992

[54] LADDER WITH WARNING GATE

[75] Inventor: James F. Kerr, Croswell, Mich.

[73] Assignee: Material Control, Inc., Croswell, Mich.

[21] Appl. No.: 622,738

[22] Filed: Dec. 5, 1990

[51] Int. Cl.[5] ..... E06C 5/34

[52] U.S. Cl. ..... 182/17; 182/18; 182/106; 182/77

[58] Field of Search ..... 182/17, 15, 129, 18, 182/106, 77, 230

[56] References Cited

U.S. PATENT DOCUMENTS

| | | | |
|---|---|---|---|
| 3,552,521 | 1/1971 | Tate | 182/129 |
| 3,841,437 | 10/1974 | Caughey | 182/16 |
| 4,442,919 | 4/1984 | Fulcher | 182/63 |
| 4,664,225 | 5/1987 | Coutier | 182/77 |
| 4,982,814 | 1/1991 | Hussey | 182/230 |
| 4,991,691 | 2/1991 | Brawer | 182/106 |

FOREIGN PATENT DOCUMENTS

| | | | |
|---|---|---|---|
| 838816 | 5/1952 | Fed. Rep. of Germany | 182/77 |

*Primary Examiner*—Reinaldo P. Machado
*Attorney, Agent, or Firm*—Dykema Gossett

[57] ABSTRACT

A ladder is disclosed which includes gate members to block access to the ladder. The gate members preferably include a warning against unauthorized use of the ladder. The ladder may be mounted on wheels such that it may be transportable, for uses in environments such as warehouses. Since these environments may be exposed to customer use, the warnings may prevent unauthorized use of the ladder by customers.

17 Claims, 1 Drawing Sheet

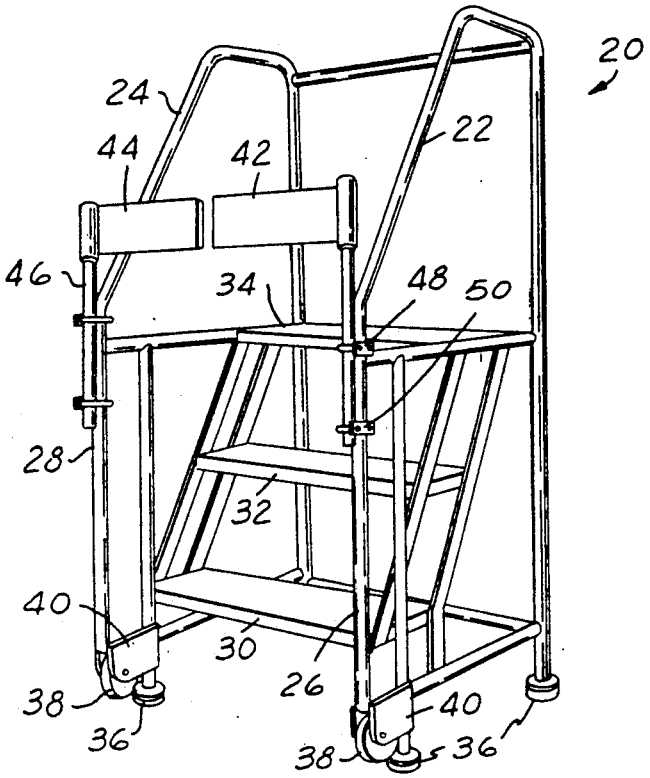
FIG. 1
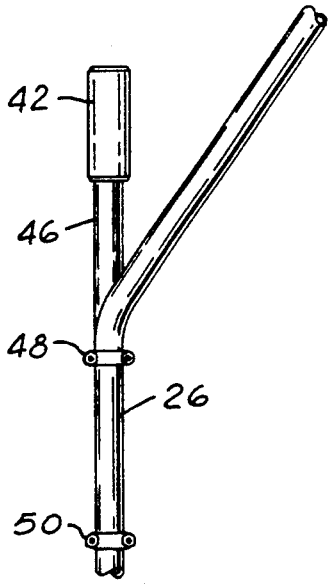
FIG. 2
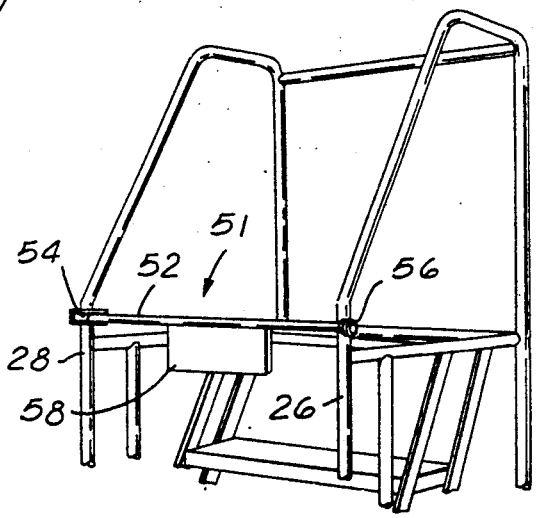
FIG. 3
FIG. 4
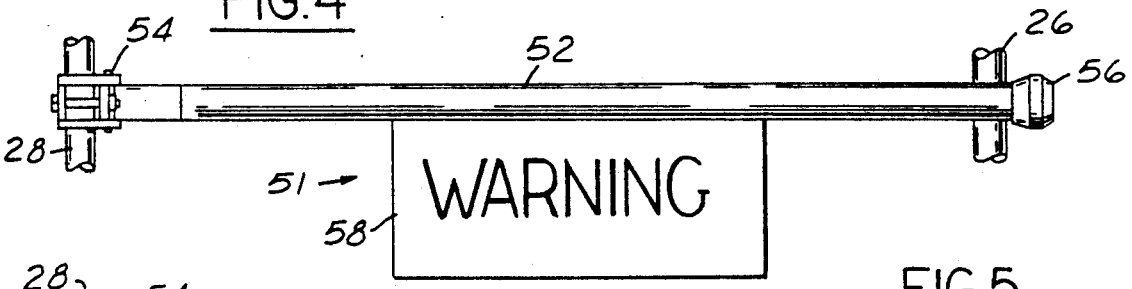
FIG. 5
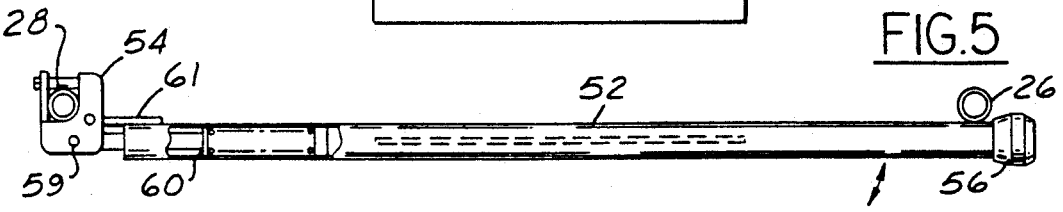

LADDER WITH WARNING GATE

BACKGROUND OF THE INVENTION

The present invention relates to a ladder having a gate which blocks access to the ladder and includes a warning against unauthorized use of the ladder.

Ladders are often used to reach remote stock mounted on shelves in buildings such as warehouses. These ladders may be mounted with wheels such that they may be easily transported. Warehouse shopping stores have become popular. In such stores the public is allowed access to a warehouse environment, and can remove items for purchase from the warehouse.

Ladders as described above may be left exposed to the public. This is somewhat undesirable since the ladder may sometimes not be properly used.

It is therefore an object of the present invention to disclose a ladder in which a gate member prevents access to the ladder. Further, it is an object of the present invention to disclose such a ladder in which a warning against unauthorized use of the ladder is placed in a position on the ladder such that it will be seen by any user of the ladder.

SUMMARY OF THE INVENTION

In a disclosed embodiment of the present invention, a ladder includes at least two steps mounted at different vertical positions which extend between two lateral ends. A gate is disposed extending inwardly from at least one lateral end to block access to the ladder. The gate is preferably pivotally attached to a frame position such that although it may nominally block access to the ladder, it can be moved to gain access to the ladder.

In a most preferred embodiment of the present invention, the gate includes a warning advising against unauthorized use of the ladder. Further, the gate is preferably normally biased to a position extending parallel to the steps to block access to the ladder.

In one embodiment of the present invention, frames are positioned at each lateral side of the ladder and have gates extending laterally inwardly to block access to the ladder. In an alternative embodiment, a single gate extends across the entire lateral extent of the ladder blocking access to the ladder.

The ladder is preferably mounted on four legs. Most preferably, the ladder includes wheels such that it may be easily transported.

These and other objects and features of the present invention may be best understood from the following specification and drawings of which the following is a brief description.

BRIEF DESCRIPTION OF THE DRAWINGS

FIG. 1 is a prespective view of a first embodiment of the present invention.

FIG. 2 is a side view of a portion of the ladder illustrated in FIG. 1.

FIG. 3 is a partial perspective view of a second embodiment of the present invention.

FIG. 4 is an enlarged view of a portion of the ladder illustrated in FIG. 3.

FIG. 5 is a cross-sectional view of the ladder illustrated in FIG. 4.

DETAILED DESCRIPTION OF THE PREFERRED EMBODIMENT

A ladder 20 according to the present invention is disclosed in FIG. 1 and includes lateral sides 22 and 24. Vertically extending lateral frames 26 and 28 are associated with lateral sides 22 and 24, respectively. Steps 30, 32 and 34 extend between lateral sides 22 and 24. Ladder 20 is normally supported on legs 36. Wheels 38 are mounted a vertical distance off of the ground greater than the radius of the wheels, but less than the diameter of the wheels. In this way, ladder 20 can be pivoted off legs 36 and onto wheels 38 such that it may be moved to a new location. It is then reset on legs 36. Wheels 38 are preferably mounted in wheel mounts 40. Blocking member, or gate 42 extends inwardly from frame 26 and an opposed gate 44 extends inwardly from frame 28. Preferably, rod 46 is received in a pair of clamps 48 and 50 on each frame 26 and 28 to mount gates 42 and 44.

Most preferably, gates 42 and 44 are spring biased to the illustrated position at which they extend generally parallel to the lateral extent of 20. Both gates 44 and 42 may be pivoted against the spring bias, preferably both inwardly or outwardly of the illustrated position to provide access to steps 30, 32, 34. The spring bias then returns gates 42 and 44 to the illustrated position. Most preferably, gates 42 and 44 include a stop member, not illustrated, which prevents pivoting of the gates beyond a 45 degree extent. The details of the spring bias or the stop member form no part of this invention and are conventional arrangements within the skill of a worker in the prior art.

Further, rod 46 may be vertically adjusted within clamps 48 and 50 to adjust the vertical height of gates 42 and 44. It is preferable that the gates be at a vertical position that will be approximately equal to waist height for most adult members of the public. This height is preferable regardless of the overall height of ladder 20.

In a most preferred embodiment of the present invention, gates 42 and 44 include some warning to advise against unauthorized use of ladder 20. As an example, gates 42 and 44 may include a legend such as "WARNING AUTHORIZED USERS ONLY".

FIG. 2 shows a detail of gate 42 mounted to frame portion 26. Clamps 48 and 50 secure rod 46 and gate 42 to frame portion 26.

FIG. 3 shows an alternative gate 51. Gate 51 is mounted on rod 52 extending from pivot joint 54 affixed to frame portion 28 laterally to an abutting end 56, held by a spring bias against frame portion 26. Warning label portion 58 includes a legend such as described above.

FIG. 4 is an enlarged view of gate 51 and illustrates pivot joint 54 and end 56 which abuts frame portion 26. Blocking member 58 is shown with an exemplary legend "WARNING".

FIG. 5 is a top partially cross-sectional view of the portion of ladder 20, illustrated in FIG. 4. Pivot joint 54 is received on frame section 28 and rod 52 extends to end 56 which abuts frame portion 26. Rod 52 pivots at point 59 relative to pivot joint 54. Spring arrangement 60 biases end 56 into frame portion 26 and biases rod 52 against stop 61. The spring arrangement may be of any known type.

Ladder 20 is portable about environments such as a warehouse. It may be pivoted onto wheels 38, and off of legs 36 such that it may be moved. Unauthorized members of the public may have access to ladder 20. Gates 42, 44 and 58 not only block access to ladder 20, but also provide warnings advising against use of the ladder by unauthorized users.

Although a specific ladder has been disclosed, it should be understood that this invention would extend to any type of ladder.

Preferred embodiments of the present invention have been disclosed, however, a worker of ordinary skill in the art would realize that certain modifications would come up in the scope of this invention. Thus, the following claims should be studied in order to determine the true scope and content of the present invention.

I claim:

1. A ladder comprising:

a) a frame having a first step at a first vertical position and a second step at a second vertical position higher than said first vertical position, said first and second steps extending between lateral ends of said frame;

b) a gate member extending laterally inwardly from at least one lateral end to block access to said ladder, said gate member being pivotally attached to a first frame portion of said frame at said one lateral end; and c) said gate member is normally biased to extend generally parallel to said steps.

2. A ladder as recited in claim 1, wherein said gate member extends more than halfway across the lateral extent of said ladder.

3. A ladder as recited in claim 2, wherein said gate member extends from said first frame portion at one lateral end of said ladder across the entire lateral extent of said frame and abuts a second frame portion at the opposed lateral end of the frame.

4. A ladder as recited in claim 1, wherein said gate member includes a warning.

5. A ladder as recited in claim 1, wherein each lateral end includes a frame portion receiving a separate gate member, and wherein each of said separate gate members extend laterally inwardly from respective ends.

6. A ladder as recited in claim 1, wherein said ladder has wheels fixed at a vertical position less than said second vertical position, but off of the ground.

7. A ladder as recited in claim 6, wherein there are wheels mounted at each lateral end of said ladder.

8. A ladder as recited in claim 7, wherein said wheels are mounted at a vertical position off of the ground that is greater than a radius of said wheel, but less than a diameter of said wheel.

9. A ladder as recited in claim 6, wherein said gate member includes a warning against use of the ladder by unauthorized persons.

10. A ladder as recited in claim 9, wherein a separate gate member extends laterally inwardly from each lateral end and each of said gate members include warnings.

11. A ladder as recited in claim 1, wherein said gate member can be pivoted both inwardly and outwardly from said normal position to provide access to the ladder, but is biased back to its normal position.

12. A ladder comprising:

a) a frame having a first step at a first vertical position and a second step at a second vertical position higher than said first vertical position, said first and second steps extending between lateral ends of said frame;

b) a gate member extending laterally inwardly from at least one lateral end to block access to said ladder, said gate member being pivotally attached to a first frame portion of said frame at said one lateral end; and c) said gate member includes a warning and is mounted at a vertical position selected to approximate waist level for most adult users.

13. A ladder comprising:

a) a frame including a first step mounted at a first vertical position and a second step mounted at a second vertical position above said first vertical position, each of said first and second steps extending between lateral ends of said ladder;

b) a pair of wheels with one wheel mounted at each lateral end of said ladder such that said ladder may be easily transported; and c) a gate member extending laterally inwardly from at least one lateral end of said ladder, said gate member including a warning, said gate member being normally biased to a position at which it extends generally parallel to said steps.

14. A ladder as recited in claim 13, wherein a gate member extends laterally inwardly from each of said lateral ends, and each of said gate members includes a warning.

15. A ladder as recited in claim 13, wherein said gate member can be pivoted both inwardly and outwardly from said normal position to provide access to the ladder, but is biased back to its normal position.

16. A ladder as recited in claim 13, wherein a single gate member extends across the entire lateral extent of said ladder, and is normally spring biased to a position abutting a frame member on an opposed lateral side.

17. A ladder as recited in claim 13, wherein said gate member is vertically adjustable relative to said frame.

* * * * *